United States Patent [19]

Erfurt et al.

[11] 3,943,867

[45] Mar. 16, 1976

[54] PROCESS FOR THE PRODUCTION OF A HOLLOW BODY OF REVOLUTION AND/OR CONTAINER

[75] Inventors: Horst-Lothar Erfurt, Furstenfeldbruck; Holger Kreft, Karlsfeld; Walter Tronsberg, Munich, all of Germany

[73] Assignee: Maschinenfabrik Augsburg-Nurnberg Aktiengesellschaft, Germany

[22] Filed: July 24, 1974

[21] Appl. No.: 491,371

[30] Foreign Application Priority Data

July 24, 1973 Germany ..... 2337500

[52] U.S. Cl. ..... 113/120 H; 29/463

[51] Int. Cl.[2] ..... B21D 51/24

[58] Field of Search ..... 72/80, 81, 82, 83, 84, 72/85; 113/120 H; 29/463

[56] References Cited

UNITED STATES PATENTS

| | | | |
|---|---|---|---|
| 1,966,713 | 7/1934 | Flint | 29/463 |
| 2,160,975 | 6/1939 | Matter et al. | 113/120 H |
| 3,046,924 | 7/1962 | Kane | 72/85 |
| 3,109,400 | 11/1963 | Paulton | 72/83 |
| 3,411,334 | 11/1968 | Ernestus | 72/84 |
| 3,593,552 | 7/1971 | Fraze | 113/120 H |

OTHER PUBLICATIONS

"POWER SPINNING Conical and Tubular Parts"; reprint from Product Engineering; Aug. 1956.

*Primary Examiner*—Lowell A. Larson
*Attorney, Agent, or Firm*—Craig & Antonelli

[57] ABSTRACT

Process for the production of a hollow body of revolution and/or container including the successive steps of forming a dish-shaped blank by a non-cutting shaping operation, forming a bottom portion and an adjoining tubular portion from the blank by a turning operation, and stretching at least the upper part of the bottom portion and the tubular portion to form a convex bottom and pipe portion respectively to form the thin walled body of revolution.

39 Claims, 4 Drawing Figures

PROCESS FOR THE PRODUCTION OF A HOLLOW BODY OF REVOLUTION AND/OR CONTAINER

BACKGROUND AND SUMMARY OF THE INVENTION

This invention relates to a process for the production of a particularly thin-walled body of revolution, consisting of a pipe and a dish-shaped, convex bottom, for example for an internal pressure vessel. This body of revolution generally does not rotate about its axis, but rather is to be understood to mean, in this connection, a body of revolution or rotation which can be constructed in accordance with Guldin's rule.

It has been contemplated to manufacture a pipe and bottom, as indicated above, separately from each other, and then to weld these parts together to form the aformentioned body of revolution. This is relatively complicated and expensive. Also, this body of revolution in this case shows an interruption in its smooth line of material. The welding bond and/or the welding seam is not very desirable in most cases. However, a production of the body of revolution, for example, by turning from a solid material requires a large quantity of starting material and is likewise complicated and costly.

It is an object of this invention to produce the body of revolution with a much smaller amount of starting material from a single piece.

This object is attained, according to the invention, by producing a dish-shaped blank, adapted to the configuration of the aforementioned bottom, by means of a non-cutting shaping method; providing this blank, by a turning operation, with a turned bottom portion deformable by stretching to obtain this bottom or the respective bottom portion and with an adjoining turned tubular portion deformable by stretching to obtain the aforementioned pipe; and producing the above-mentioned body of revolution by stretching these two turned portions.

For the manufacture of this blank of a metal, particularly steel, but also aluminum, by a non-cutting shaping operation, especially by forging, preferably drop forging, a much smaller quantity of starting material is required than for the turning of the body of revolution from a solid piece. This is so because the wall thickness of the dish-shaped blank is relatively minor and its required axial extension is relatively small. This blank can be produced, due to its relatively minor axial extension, by a non-cutting shaping step, especially by drop forging. Additional advantages of the invention reside in that a great dimensional accuracy of the body of revolution is attained, that this body does not show an interruption in the smooth line of material at the transition from the bottom to the tubular section, and does not show a welding bond or seam, either, at that point; and that the expenditures for material and production are relatively minor and the method is uncomplicated. The process of this invention makes it possible to manufacture an extremely lightweight body of revolution.

A stretching step as mentioned above refers especially to a cold-forming method, for example if a blank of steel is involved, and to a hot-forming process, for example in case of a blank of titanium.

The following embodiments of the process of this invention render this process even more advantageous, in particular increase the above-mentioned dimensional accuracy, improve the smooth line of the material at the aforementioned transition zone, and even further reduce the axial extension of the blank:

The stretching of the turned bottom portion is, in particular a projection stretching process, which is also called a projection stretch-forming pressing step. The stretching step for the tubular turned portion is especially a cold extrusion process. In particular, the turned bottom portion assumes, by the turning operation, the shape of an outwardly projecting bead and has a wall thickness increasing toward the turned tubular portion. The longitudinal cross-sectional area and the length of the bead are so large that, due to the stretching step, the desired wall thickness and curved length of the bottom and/or the associated bottom portion are attained. The turned bottom portion is stretched, in particular, by means of a pressure or stretching mandrel and by means of pressure or stretching rollers. Advantageously, the above-mentioned bead is fashioned, by the turning operation, with a shoulder for the engagement of pressure or stretching rollers. This has the result that the material, starting right from the stretching step, flows and is not ruptured. However, due to the turning operation, the turned pipe portion is provided, in particular, with a uniform wall thickness. In most cases, this wall thickness is larger than the maximum wall thickness of the above-mentioned bead. This wall thickness is so large that, together with the length of the turned tubular portion, the desired wall thickness and length of the pipe are obtained by the stretching process. In most instances, the volume of the turned tubular portion is selected so that, after stretching, the wall thickness of this tube (pipe) is as large or approximately as large, as the wall thickness of the bottom or bottom portion. However, the volume can also be chosen so that, after stretching, the wall thickness of the pipe is twice as large, or approximately twice as large, as the wall thickness of the bottom or bottom portion. This is of special importance for the manufacture of internal pressure vessels, which will be explained below.

A process according to the invention for the production of a container by means of the process of this invention as set out hereinabove resides in that two above-mentioned bodies of revolution, having the same pipe diameter, are manufactured, and the two pipes thereof are joined at their end faces with each other by welding or soldering. The thus-obtained container has only a single weld seam. Furthermore, a process of this invention for the manufacture of a container from a body of revolution produced according to the process of this invention resides in that the body of revolution is provided, at its open end, with a likewise dish-shaped, convex bottom, by joining this bottom and the pipe via their end faces with each other by means of welding or soldering. The thus-obtained container likewise has only a single weld seam.

In both cases, the welding step is preferably an electron beam welding procedure, since the high dimensional accuracy attained by the process of this invention ensures a satisfactory bond by means of electron beam welding. For example, tolerances of less than 0.04 mm. can be obtained at a pipe diameter of approximately 300 mm. and a pipe wall thickness of 2 mm.

According to an aforementioned container manufacturing method, an internal pressure vessel can also advantageously be produced by utilizing especially that aforementioned embodiment of the process, according to which the wall thicknesses of the pipe and of the bottom are the same, or approximately the same, and wherein the two pipes and/or the pipe, after this welding or soldering bonding step, are and/or is provided with a wound jacket of fiber-reinforced synthetic resin or wire, absorbing at least part of the internal pressure. This jacket is preferably so strong and/or so firm and so thick that it absorbs about 50 % of the internal pressure and/or the internal pressure forces, while the pipes or pipe likewise absorb or absorbs about 50%. This is very advantageous, because the body of revolution having identical wall thicknesses of its pipe and its bottom can be manufactured at low expenditure and with a very smooth flow of the line of material at the transition from the bottom to the pipe-shaped portion. At the same internal pressure, without this jacket, however, the wall thickness of the pipe must be about twice as large as that of the bottom. If desirable or necessary, the two bottoms can additionally be provided with a wound jacket of the aforementioned type, absorbing at least part of the internal pressure. The internal pressure of the container, which can be relatively high, can stem from a gaseous or liquid medium which is to be housed in the container. The above-mentioned fiber-reinforced synthetic resin is preferably a carbon-fiber-reinforced plastic. Such an aforementioned body of revolution or container is intended, for example, for the reception of a gaseous or liquid medium in an automotive vehicle, an aircraft, or a space vehicle.

The bottom of the body of revolution is preferably hemispherical, but it can also have some other configuration, such as a semielliptic shape, or the like, for example.

DETAILED DESCRIPTION OF THE DRAWINGS

Figure 1:
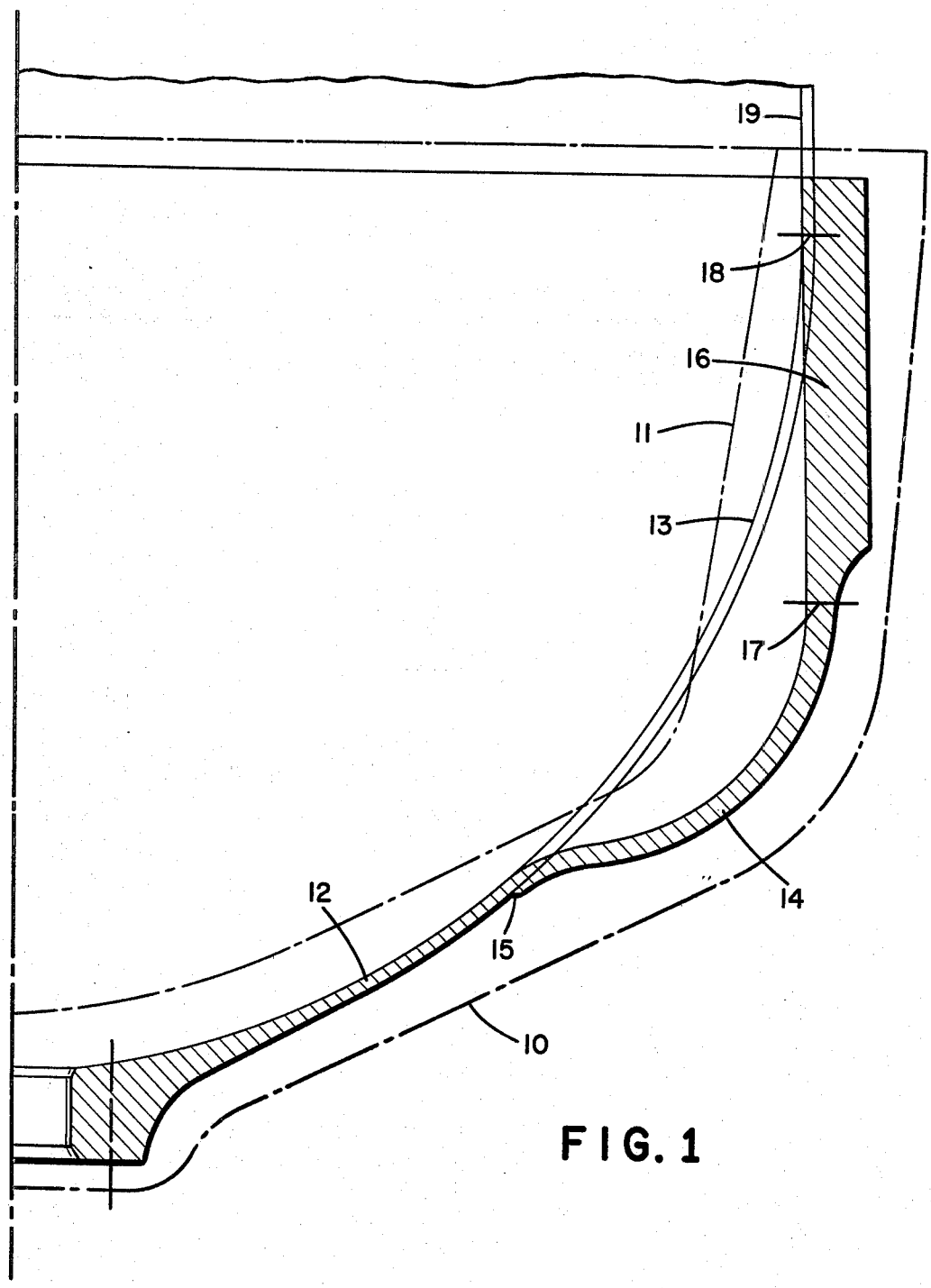
FIG. 1 of the drawings shows an example for conducting the process of this invention to produce a thin-walled body of revolution of the above-described type, illustrating a longitudinal section through the dish-shaped forms of the various process steps, wherein these forms, for the sake of simplicity, are shown on only one side of the axis.

According to FIG. 1, a forged blank is shown in dot-dash lines. This blank is a body of revolution according to Guldin's rule, is dish-shaped, and extends from the central zone first relatively flat — section 10 — and then more steeply — section 11. This blank 10, 11 is adapted to the shape of the hemispherical bottom of the body of revolution to be produced from the blank. This bottom is illustrated, starting with the central zone, first by the shaded portion and then in thin lines. The body of revolution to be produced, i.e., the finished body, has, following this bottom and/or a part 13 of this bottom, a relatively long, cylindrical pipe 19, the wall thickness of which is equal to that of the bottom or bottom portion 13. The dish-shaped blank 10, 11 comprises, in spite of its axially relatively minor extension from the central zone, one behind the other the parts from which this bottom and this pipe are produced. The shaded portion 12 of this bottom is manufactured from part 10 of the blank 10, 11 by a turning operation. The portion 13 of this bottom, shown in thin lines, is produced from parts 10 and 11 of the blank by a turning procedure and a subsequent projection stretching of the thus-obtained turned bottom portion. The turned bottom portion obtained by this turning step includes a bead or bulge 14 projecting radially toward the outside, beginning with a shoulder 15 for pressure or stretching rollers, not shown, and the wall thickness of which increases toward the tubular turned portion 16; all of this is achieved by this turning operation. The turned tubular portion 16 follows the bulge 14 and is produced from portion 11 of the blank by a turning step. The turned pipe portion 16 is cylindrical and is oriented coaxially. The wall thickness of this latter portion is more than twice as large as the maximum wall thickness of the bulge 14, measured at point 17.

First the bottom portion 12 is turned, then the shoulder 15 and the bulge 14, and then the turned tubular portion 16, all of this being done by means of numerical control or by means of a copying template. Thereafter follows the projection stetching of the bulge 14 to form the bottom portion 13; the point 17 ends up at point 18 — axial end of part 13 — whereafter a cold extrusion of the turned pipe portion 16 to form the pipe 19 is effected, in most cases by means of different pressure or stretching rollers. The following is not illustrated separately for the sake of simplicity: The projection stretching of the bulge 14 is accomplished on a hemispherical, rotating pressure or stretching mandrel; the cold extrusion of the turned pipe portion 16 takes place on a cylindrical, rotating extrusion mandrel; the body to be stretched is firmly clamped onto the respective mandrel.

Figure 2:
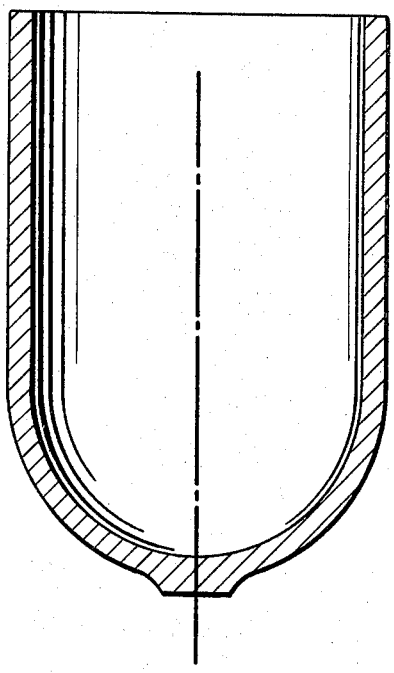
FIGS. 2 and 3 of the drawings show embodiments of finished bodies of revolution as manufactured in accordance with the process of this invention, in a longitudinal sectional view.

The volume of the turned pipe portion 16 is selected so that, after the cold extrusion step, the wall thickness of the pipe 19 is as large as the wall thickness of the bottom portion 13. This can also be seen clearly from FIG. 2.

Figure 3:
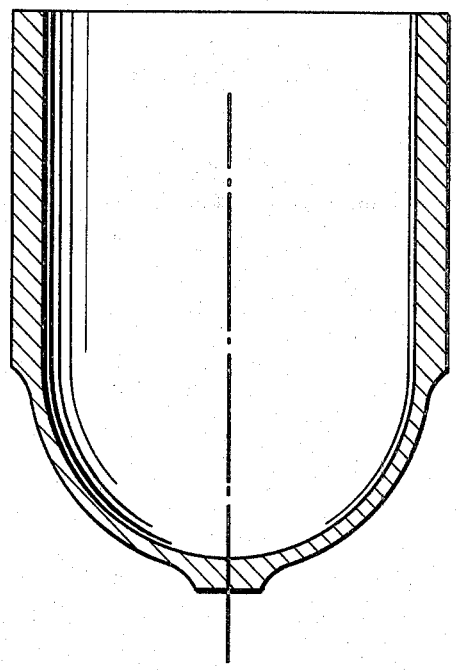

In contrast thereto, in the body of revolution according to FIG. 3, the volume of the turned tubular portion has been chosen so that, after the cold extrusion step, the wall thickness of the pipe is twice as large as the wall thickness of the bottom.

Figure 4:
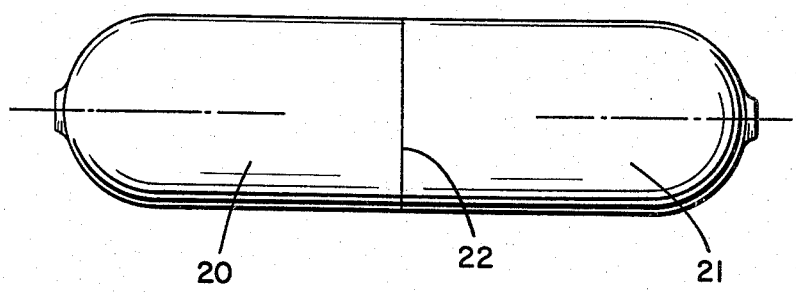
FIG. 4 of the drawing shows an embodiment of a container produced by way of the process of this invention, in a front view.

If, by means of the above-described process, two bodies of revolution as set forth above, with the same pipe diameter, are produced, and the two pipes 20 and 21 are subsequently welded together by way of their end faces, the container or internal pressure vessel of FIG. 4 is obtained, having a single weld seam 22.

Although the invention resides primarily in the combination of process steps as described above and set out in the appended claims, the following dimensional example is included to aid those skilled in the art in practicing the invention. This dimensional example is in no way intended to limit the scope of the claims. In a practical example, the wall thicknesses, referring to FIG. 1, may be as follows: 2 mm. for part 12 adjacent the shoulder 15; 3 mm. for the bulge 14 at the shoulder 15 with a constant taper of bead 14 to a thickness of 5 mm. at point 17; 12 mm. for part 16. After completion of the process steps, when forming the body of revolution shown in FIG. 2, the thicknesses of 12, 13, and 19 will be 2 mm. (it being noted that portion 12 is completed during the turning operation). The selected thicknesses for the wall is dependent on the desired strength necessary for the in-use internal pressure to be experienced by a container formed with the body of revolution. When the lower portion 12, 13 is formed as a hemisphere, the diameter of this hemispherical portion and the cylindrical portion 19 will be the same in the finished container. For example, the diameter of the pipe portion 19 can be in the range of 250 to 1300 mm. with wall thicknesses of 1 to 3 mm.

As noted above, the part 12 is produced in final form by turning, with parts 14 and 16 being subsequently stretched. The bulge 14 may be disposed more closely to the axis of the container than in the illustrated FIG. 1 embodiment so as to have only a very small part 12 to be completed by the turning operation. This bulge 14 which has a conical type shape after the turning operation is projection stretched by being deformed to a hollow-spherical or the like part by way of pressure or stetching rollers applied thereto, with shoulder 15 facilitating application of these rollers. The hollow cylinder portion 16 is deformed to a thin, longer hollow cylinder by way of further pressure or stretching rollers in a cold extrusion process. When the blanks are constructed of steel, the bulge 14 is projection-stretched in the cold state and portion 16 is also cold extruded. In embodiments using a blank of titanium, bulge 14 is projection stretched in the warm state and 16 is also warm extruded.

In embodiments utilizing reinforcing fibers, such fibers are preferably of an organic resin, such as polyester, epoxy resin, or polyamide, however the material could also be a metal such as aluminum. The diameter of the individual fibers is preferably in the range of between 0.1 to 0.3 mm. Referring to FIG 4, crosswise windings are first produced, the winding operation being carried out continuously in multiple laps from one bottom to the other in spiral configuration, particularly two to three layers. Then, the cylindrical part is continuously provided with windings, preferably two to three additional layers, with each of the layers having a thickness of, for example, 1 mm. when the wall thickness of the container is 1.7 mm. For bodies designed to withstand approximately 300 atmospheres internal pressure, a total winding thickness of approximately 10 is preferred. For lesser internal pressures, lesser thickness of windings can be used.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Process of producing a thin-walled body of revolution having a dish-shaped convex bottom adjoining a cylindrical pipe portion comprising:

forming a dish-shaped blank by a non-cutting shaping operation, forming a bottom portion and an adjoining tubular portion from said blank by a cutting turning operation, and stretching at least the upper part of said bottom portion and said tubular portion to form said convex bottom and said pipe portions respectively.

2. Process according to claim 1, characterized in that the stretching of the turned bottom portion is effected by a projection stretching step.

3. Process according to claim 2, characterized in that the stretching of the turned tubular portion is effected by an extrusion step.

4. Process according to claim 3, characterized in that during the turning operation, the upper part of the bottom portion is provided with the shape of a radially outwardly projecting bulge having a wall thickness increasing in the direction of the turned tubular portion.

5. Process according to claim 4, characterized in that during the turning operation said bulge is provided with a shoulder for engagement of pressure or stretching rollers.

6. Process according to claim 4, wherein said radially outwardly projecting bulge is formed into a portion of said dish-shaped convex bottom by means of a projection stretching step.

7. Process according to claim 3, characterized in that, during the turning operation, the tubular portion receives a uniform wall thickness.

8. Process according to claim 3, characterized in that the volume of the turned tubular portion is formed so that, after the stretching step, the wall thickness of the pipe portion is approximately as large as the wall thickness of the adjoining convex bottom.

9. Process according to claim 3, characterized in that the volume of the turned tubular portion is formed so that, after the stretching step, the wall thickness of the pipe portion is approximately twice as large as the wall thickness of the adjoining convex bottom.

10. Process according to claim 3, characterized in that two aforementioned bodies of revolution, having the same pipe portion diameter, are produced, and that the two pipe portions thereof are joined via their end faces by welding or soldering to form a container.

11. Process according to claim 10, characterized in that the welding step is an electron beam welding process.

12. Process according to claim 3, characterized in that the body of revolution is provided at its open end at said pipe portion with a likewise dish-shaped, convex bottom portion, by joining this convex bottom portion and the pipe portion together by way of their end faces, by means of welding or soldering.

13. Process according to claim 12, characterized in that the welding step is an electron beam welding process.

14. Process according to claim 1, characterized in that stretching of the turned tubular portion is effected by an extrusion step.

15. Process according to claim 1, characterized in that during the turning operation, the upper part of the bottom portion is provided with the shape of a radially outwardly projecting bulge having a wall thickness increasing in the direction of the turned tubular portion.

16. Process according to claim 15, characterized in that, during the turning operation, said bulge is provided with a shoulder for the engagement of pressure or stretching rollers.

17. Process according to claim 15, wherein said radially outwardly projecting bulge is formed into a portion of said dish-shaped convex bottom by means of a projection stretching step.

18. Process according to claim 1, characterized in that, during the turning operation, the tubular portion receives a uniform wall thickness.

19. Process according to claim 1, characterized in that the volume of the turned tubular portion is formed so that, after the stretching step, the wall thickness of the pipe portion is approximately as large as the wall thickness of the adjoining convex bottom.

20. Process according to claim 19, characterized in that two aforementioned bodies of revolution, having the same pipe portion dimater, are produced, and that the two pipe portions thereof are joined via their end faces by welding or soldering to form a container.

21. Process according to claim 20, characterized in that the two pipe portions, after being connected by welding or soldering, are provided with a wound jacket of a fiber-reinforced synthetic resin or of wire, for absorbing at least part of the internal pressure to be experienced in use of said container as an internal pressure vessel.

22. Process according to claim 21, characterized in that additionally the two bottoms are provided with a wound jacket of the aforementioned type for absorbing at least part of the internal pressure.

23. Process according to claim 19, characterized in that the body of revolution is provided at its open end at said pipe portions with a likewise dish-shaped, convex bottom portion, by joining this convex bottom portion and the pipe portion together by way of their end faces, by means of welding or soldering.

24. Process according to claim 23, characterized in that the pipe portion and bottom portion, after being connected by welding or soldering, are provided with a wound jacket of a fiber-reinforced synthetic resin or of wire, for absorbing at least part of the internal pressure to be experienced in use of said container as an internal pressure vessel.

25. Process according to claim 24, characterized in that additionally the two bottoms are provided with a wound jacket of the aforementioned type for absorbing at least part of the internal pressure.

26. Process according to claim 1, wherein the pipe portion of said thin-walled body of revolution is cylindrical and further wherein said dish-shaped convex bottom is convex with respect to said pipe portion.

27. Process according to claim 1, wherein said dish-shaped blank is adpated to the dish-shaped convex bottom of said thin-walled body of revolution.

28. Process according to claim 27, wherein said dish-shaped blank is formed so that an axial cross section of said dish-shaped blank substantially encompasses the respective axial cross section of the dish-shaped convex bottom of said thinwalled body of revolution.

29. Process according to claim 28, wherein said dish-shaped blank is formed from a relative flat section and a steeper section attached thereto, the cross section of the dishshaped convex bottom of said thin-walled body of revolution being encompassed by the respective cross section of said dish-shaped blank except at the location at which said relatively flat section joins said steeper section.

30. Process according to claim 27, wherein said dish-shaped convex bottom is hemispherical, the maximum axial and radial dimension of said dish-shaped blank being approximately equal to the radius of said hemispherical bottom.

31. Process according to claim 1, characterized in that the volume of the turned tubular portion is formed so that, after the stretching step, the wall thickness of the pipe portion is approximately twice as large as the wall thickness of the adjoining convex bottom.

32. Process according to claim 1, characterized in that two aforementioned bodies of revolution, having the same pipe portion diameter, are produced, and that the two pipe portions thereof are joined via their end faces by welding or soldering to form a container.

33. Process according to claim 32, characterized in that the welding step is an electron beam welding process.

34. Process according to claim 1, characterized in that the body of revolution is provided at its open end at said pipe portion with a likewise dish-shaped, convex bottom portion, by joining this convex bottom portion and the pipe portion together by way of their end faces, by means of welding or soldering.

35. Process according to claim 34, characterized in that the welding step is an electron beam welding process.

36. Process according to claim 1, wherein said dish-shaped convex bottom is hemispherical.

37. Process for producing a thin-walled body of revolution having a cylindrical pipe portion adjoining a dish-shaped bottom convex with respect to said pipe portion comprising:

forming a dish-shaped blank, forming a bottom portion and an adjoining tubular portion from said blank by a cutting turning operation only, said bottom portion defining a lower part and an upper part, said lower part defining a sector of a sphere, said upper part defining a radially outwardly projecting bulge, shaping the upper part of said bottom portion to form a hemisphere with the lower part of said bottom portion by a projection stretching step, and stretching said tubular portion to form said pipe portion by a non-cutting shaping operation.

38. Process according to claim 37, wherein said pipe portion is cylindrical.

39. Process according to claim 38, wherein said tubular portion is cylindrical.

* * * * *